United States Patent [19]

Teramachi

[11] 3,961,559

[45] June 8, 1976

[54] ACTUATOR

[76] Inventor: Hiroshi Teramachi, No. 34-8; Higashi-tamagawa 2-chome, Setagaya Tokyo, Japan

[22] Filed: Nov. 18, 1974

[21] Appl. No.: 524,997

[52] U.S. Cl. ..... 91/189 R; 91/401; 91/412; 91/422; 92/2; 92/33; 92/177

[51] Int. Cl.[2] ..... F01B 21/02; F15B 11/20; F15B 13/06

[58] Field of Search ..... 92/2, 33, 65, 31, 177; 91/61, 411, 412, 422, 222, 189, 401

[56] References Cited

UNITED STATES PATENTS

| | | | |
|---|---|---|---|
| 2,378,409 | 6/1945 | Joy | 91/422 X |
| 2,893,210 | 7/1959 | Muszynski | 92/65 X |
| 2,955,579 | 10/1960 | Block | 92/33 |
| 3,656,411 | 4/1972 | Plester et al. | 91/422 X |
| 3,766,831 | 10/1973 | Yeakley | 92/2 |

FOREIGN PATENTS OR APPLICATIONS

| | | | |
|---|---|---|---|
| 1,954,780 | 5/1971 | Germany | 92/33 |
| 222,095 | 7/1968 | U.S.S.R. | 92/33 |

*Primary Examiner*—Irwin C. Cohen
*Attorney, Agent, or Firm*—McGlew and Tuttle

[57] ABSTRACT

The actuator comprises a cylinder of non-circular cross section, two types of pistons and a piston rod which is provided with at least one spiral male thread having a pre-determined helical angle at a pre-determined pitch. One of the pistons is mounted on the piston rod for rotation relative thereto while being fixed against axial displacement therealong, and is provided with two relief pressure control valves opening in respective opposite directions, and the other piston is provided with at least one female spiral thread engaged with the male thread on the piston rod. The rod can thus reciprocate in the cylinder in opposite axial directions and can rotate, relative to the cylinder, in opposite angular directions.

3 Claims, 6 Drawing Figures

ACTUATOR

BACKGROUND OF THE INVENTION

1. Field of the Invention

The present invention relates in general to an actuator which is widely used in hydraulic power transmission, such as for a transfer machine, an automatic stock feed, an automatic stamp, etc., and, in particular, to a new and useful actuator of which a piston rod can reciprocate in opposite axial directions and rotate in opposite angular directions.

2. Description of the Prior Art

There are known piston-cylinder actuators operable by the pressure of hydraulic fluid, but these actuators have cylinders of circular cross section. Accordingly, a piston rod of such circular cylinder can accurately effect reciprocable longitudinal movements but, when rotary movements of the piston rod are required in combination with longitudinal movements thereof, or when such actuator is used with a machine wherein a torque is effective on the piston rod, the piston rod cannot accurately effect longitudinal or rotary movements inasmuch as there is nothing to oppose rotation of the piston rod responsive to torques, exerted thereon, so that the piston rod might be rotated, responsive to applied torques, between longitudinal reciprocating movements. Consequently, in prior actuators, a projection which acts the part of a guide by being engaged with a groove which is provided on the piston is provided on the inside of the cylinder, whereby the piston rod permits accurate longitudinal or rotary movements in the event of the above-mentioned circumstances.

But, in such means, the durability of the actuator is reduced because it is unavoidable that the projection and groove are damaged by torques effective on the piston rod.

SUMMARY OF THE INVENTION

In accordance with the present invention, the improved actuator comprises a cylinder having a non-circular cross section and a center axis, two types of pistons watertightly movable in the cylinder and dividing the cylinder interior into three chambers, and a piston rod having at least one male spiral thread at of predetermined pitch and helical angle. The piston extends coaxially along the center axis of the cylinder and in watertight relation through the centers of the two pistons. The piston rod also extends through end walls on the opposite ends of the cylinder. One of the pistons is formed with two relief pressure control valves opening in respective opposite directions and is rotatable on the piston rod while being restrained against axial movement therealong. The other piston is provided with at least one female spiral thread engaged with the male spiral thread on the piston rod. The end walls are formed with ports or apertures through which hydraulic fluid is supplied to and exhausted from the three chambers.

Accordingly, it is an object of the present invention to provide an actuator which has a high degree of accuracy in cyclic movements and it is another object to provide an actuator having an excellent durability.

A more detailed explanation of the present invention is provided in the following description, and is illustrated in the accompanying drawings.

DESCRIPTION OF THE PREFERRED EMBODIMENT

Figure 1:
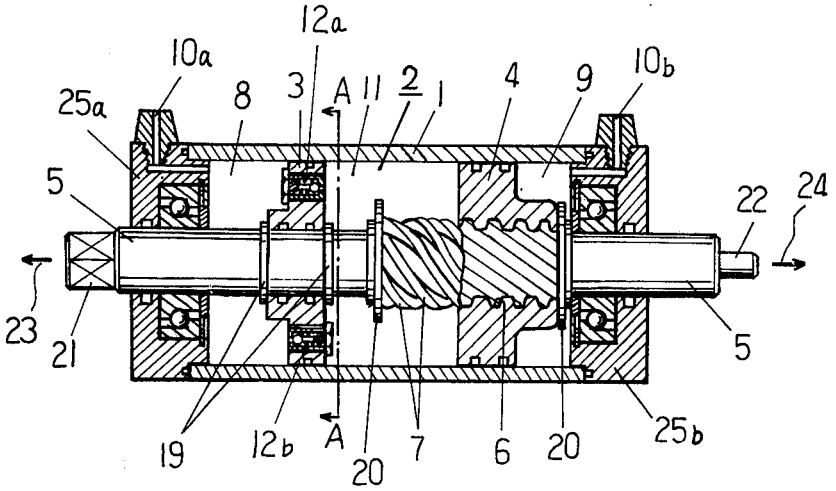
FIG. 1 is a longitudinal sectional view of an improved actuator according to the present invention showing a first state of cyclic movements.
Figure 2:
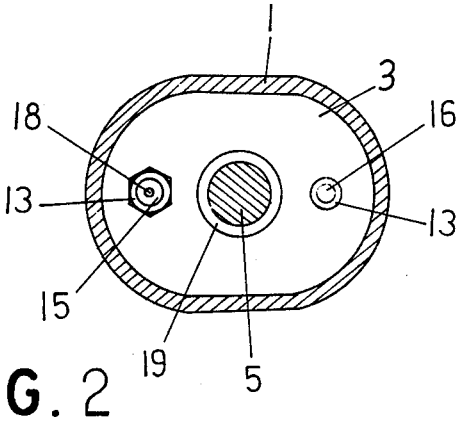
FIG. 2 is a cross sectional view taken on line A—A in FIG. 1.
Figure 3:
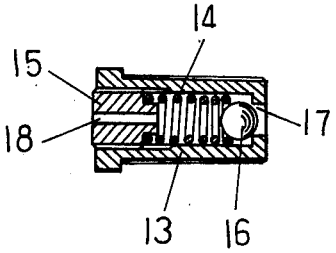
FIG. 3 is a longitudinal sectional view of a relief pressure control valve.

Referring to FIGS. 1 through 3, there is shown an improved actuator according to the present invention and a concrete example of a relief pressure control valve. The actuator comprises a cylinder 1, walls 25*a* and 25*b* at opposite ends of the cylinder 1, two types of pistons 3 and 4, and a piston rod 5 which is extended through the pistons and the end walls. The cylinder 1 of the actuator is of oval cross section as shown in FIG. 2, and each end wall is provided with a respective aperture, port, or slot 10*a* or 10*b* through which the hydraulic fluid is supplied and exhausted through a selector valve, such as solenoid valve, etc. (not shown). The piston rod 5 is provided with plural spiral male threads having a pre-determined helical angle at a pre-determined pitch, is located along the center axis of the cylinder 1 and is watertightly extended through end walls 25*a* and 25*b* which act as bearings. Two kind of pistons 3 and 4 are watertightly movable in the cylinder 1 and divide the cylinder interior 2 into three chambers 8, 9 and 11. One piston 3 is provided with two relief pressure control valves 12*a* and 12*b* opening in respective opposite directions and is locked against axial displacement on the piston rod 5 by two rigid rings 19 and 19 but the piston rod 5 can be rotated therein. The other piston 4 is provided with plural female spiral threads 6 which are watertightly and movably engaged with the male spiral threads 7 of the piston rod 5. Each relief pressure control valve 12*a* and 12*b* as shown in FIG. 3, comprises a body 13 having valve seat 17, a coil spring 14, an adjusting screw 15 having a bore 18 and a ball 16. The pressure in the chamber 11 is determined by adjusting the valve 12*a*, and the valve 12*b* also is adjusted in the same manner as the valve 12*a*. Two stop rings 20 and 20 are provided on the piston rod 5 at opposite ends of the threads 7, so that the longitudinal movements and rotary movements of the piston rod 5 are limited and pre-determined. The port 10*a* of the wall 25*a* opens into the chamber 8 which is formed by the wall 25*a* and the piston 3, and the chamber 8 communicates with the chamber 11, which is formed by two pistons 3 and 4, through the valves 12*a* and 12*b*. The other port 10*b* of the wall 25*b* opens into the chamber 9 which is formed by the wall 25*b* and the piston 4. Reference numerals 21 and 22 designate mounting parts rotating in opposite directions after advancing from the wall 25*a* or 25*b* of the cylinder 1.

The improved actuator according to the present invention consists of the above-mentioned components. Consequently, when the actuator is used, as the preparatory step, the selector valve (not shown) is operated and the plot 10*b* is connected to exhaust. Thereby, the high pressure hydraulic fluid, such as air, oil, water, etc.

is fed into the chamber 11 through port 10*a* and the chamber 8, and the pressure of the hydraulic fluid, which is determined by the relief pressure control valves 12*a* and 12*b*, is applied to the chamber 11.

At the first step of the cyclic movements, the selector valve is operated and the slot 10*a* is connected to exhaust, the high pressure hydraulic fluid is fed into the chamber 9 through the port 10*b*, and the pressure in chamber 9 rises and is exerted on the piston 4. At this time, the pressure exerted on the piston 4 is transmitted to the chamber 8 because the back pressure, which is pre-determined, is applied to the piston 4 owing to closing of the valve 12*a* and the hydraulic fluid in the chamber 8 is connected to exhaust. Thereby, the piston rod 5 is rectilinearly advanced in the direction of arrow 23 (FIG. 1) as far as the position of the piston rod 5 and the piston 3 and 4 as shown in FIG. 4, with the pistons 3 and 4 maintaining their spacing on the piston rod 5.

Figure 4:
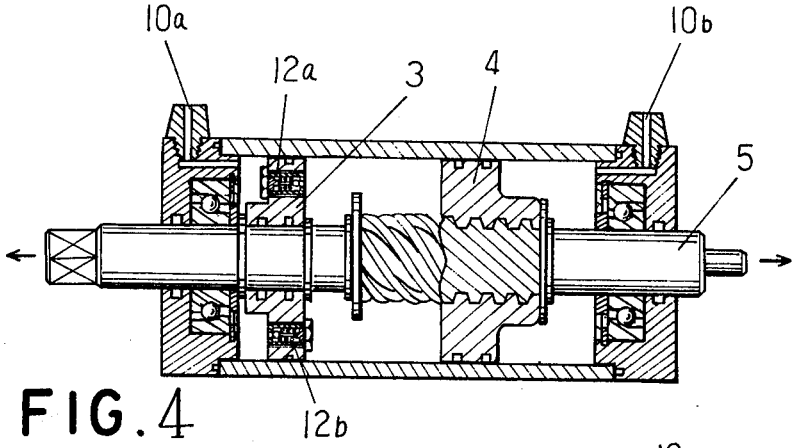
FIGS. 4–6 are longitudinal sectional views of FIG. 1, showing second, third and fourth states of cyclic movements.
Figure 5:
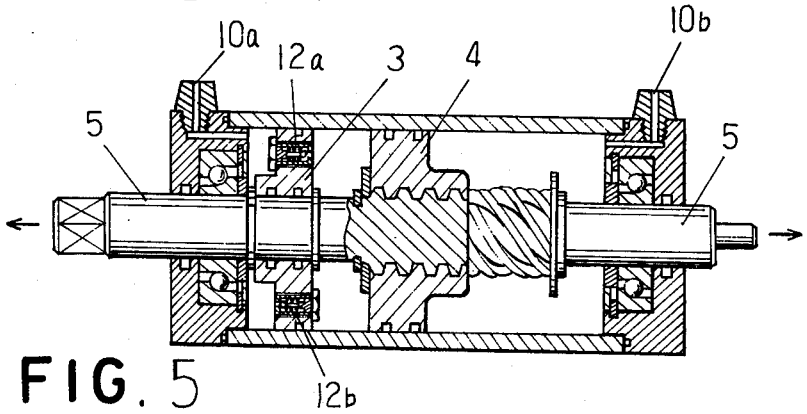

At the second step of the cyclic movements, with the state as shown in FIG. 4, more hydraulic fluid is supplied into the chamber 9, and the pressure in the chamber 9 is raised higher than the pressure in the chamber 11. Thereby, the piston 4 is advanced to rotate the piston rod 5 due to the torque exerted responsive to the interengagement of the plural female spiral thread 6 of piston 4 with the plural male spiral threads 7 of piston rod 5, until piston rod 5 cannot be advanced any further due to engagement of piston 4 with the lefthand ring 20. At this time, the pressure in the chamber 11 is kept at the pre-determined pressure by the relief pressure control valve 12*a*. The piston 4 finally reaches the position as shown in FIG. 5.

At the third step of the cyclic movements, the selector valve is operated again and the port 10*b* is connected to exhaust, the hydraulic fluid is supplied to the chamber 8 through the port 10*a*, and the pressure in the chamber 8 is exerted on the piston 3. Thereby, the piston rod 5 is rectilinearly advanced in the direction of arrow 24 (FIG. 1) as far as the position of the piston rod 5 and the pistons 3 and 4 as shown in FIG. 6, while the pistons 3 and 4 maintain their mutual spacing on the piston rod 5.

Figure 6:
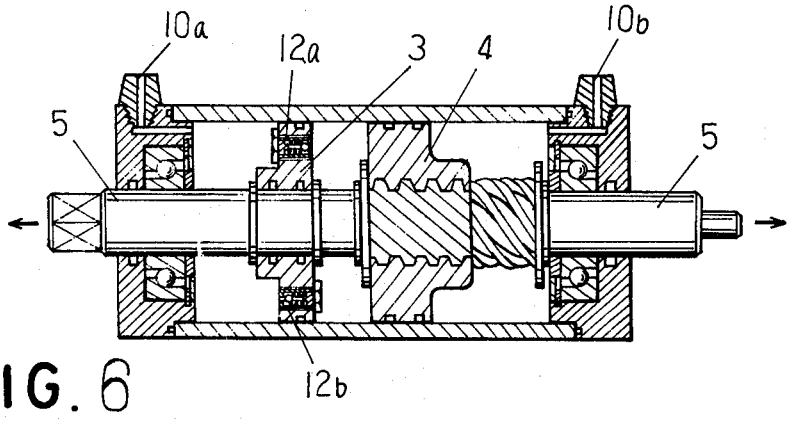

At the fourth step of the cyclic movements, with the state as shown in FIG. 6, more hydraulic fluid is supplied into the chamber 8, and the pressure in the chamber 8 is raised higher than the pressure in the chamber 11. Thereby, the relief pressure control valve 12*b* is operated, and the pressure in the chamber 11 increases and is exerted on the piston 4. Thus, the piston 4 is advanced in order to rotate the piston rod 5 as the piston rod 5 and the piston 4 are perfectly returned to the first position as shown in FIG. 1.

The above-mentioned cyclic movements are continuously achieved by operating the selector valve and operation of the two relief pressure control valves 12*a* and 12*b*.

In above-mentioned cyclic movements, the actuator according to the present invention achieves a high degree of accuracy of the cyclic movements by reason of controlling the movements of the piston 4 through the relief pressure control valves 12*a* and 12*b*.

Further, the actuator according to the present invention has a higher degree of durability than prior actuators because, torques on the piston rod, which are applied from the outside of the actuator, are loaded on the whole body of the piston 4 in place of merely the slot and groove guide of prior actuators.

What is claimed is:

1. An actuator, operable by hydraulic fluid under pressure, comprising, in combination, an axially elongated cylinder having a non-circular cross-section throughout its length and having a central axis; end walls closing the opposite ends of said cylinder; first and second non-circular and non-rotatable axially spaced pistons in said cylinder in direct engagement with the interior surface thereof and dividing said cylinder into first and second end chambers and an intermediate chamber; a piston rod extending through said pistons and said end walls, to project beyond said end walls, coaxially with said center axis, said piston rod being rotatable relative to said pistons; means restraining relative axial displacement of said piston rod and said first piston; said piston rod being formed with at least one male spiral thread and said second piston being formed with at least one female spiral thread engaged with a respective said male spiral thread; first and second relief pressure valves in said first piston communicating with said first chamber and said intermediate chamber, and opening in respective opposite axial directions; said first relief pressure valve opening toward said first chamber and said second relief pressure valve opening toward said intermediate chamber; and first and second port means in respective end walls for selectively supplying hydraulic fluid to said chambers and exhausting hydraulic fluid therefrom, said first port means communicating with said first chamber and said second port means communicating with said second chamber; whereby, when said first port means is connected to exhaust and said second port means is connected to a source of hydraulic fluid under pressure, said first and second pistons will advance said piston rod, without rotation thereof, toward the end wall having said first port means with said first relief pressure valve blocking communication between said first chamber and said intermediate chamber until said first piston is blocked from further movement toward the end wall having said first port means; said second piston then advancing toward said first piston with the pressure in said intermediate chamber opening said first relief pressure valve to exhaust fluid from said intermediate chamber into said first chamber and out through said first port means, said second piston, due to its threaded engagement with said piston rod, rotating said piston rod; said first and second pistons, upon connection of said first port means to a supply of hydraulic fluid under pressure and said second port means to exhaust, initially moving said piston rod without rotation in a direction toward the end wall having said second port means with said second relief pressure valve blocking communication between said first chamber and said intermediate chamber; upon blockage of movement of said piston rod toward said end wall having said second port means and continued supply of hydraulic fluid to said first port means, said second relief pressure valve connecting said first chamber to said intermediate chamber opens to increase the pressure in said intermediate chamber to advance said second piston toward the end wall having said second port means to effect reverse rotation of said piston rod.

2. An actuator, as claimed in claim 1, including means limiting movement of said second piston toward said first piston.

3. An actuator, as claimed in claim 1, including means limiting movement of said piston rod toward the end wall having said second port means.

* * * * *